US010308424B2

(12) United States Patent
Vancampen

(10) Patent No.: US 10,308,424 B2
(45) Date of Patent: Jun. 4, 2019

(54) CORNER PIECE FOR FORMING A CORNER OF A CONTAINER, CONTAINER PROVIDED WITH SUCH CORNER PIECE, AND GRIPPER ARM AND GRIPPER WHICH CAN COOPERATE WITH SUCH CORNER PIECES

(71) Applicant: CAMING SOLUTIONS BVBA, Elsene (BE)

(72) Inventor: Tim Vancampen, Berlaar (BE)

(73) Assignee: CAMING SOLUTIONS BVBA, Elsene (BE)

( * ) Notice: Subject to any disclaimer, the term of this patent is extended or adjusted under 35 U.S.C. 154(b) by 545 days.

(21) Appl. No.: 14/783,328

(22) PCT Filed: Apr. 8, 2014

(86) PCT No.: PCT/IB2014/060517
§ 371 (c)(1),
(2) Date: Oct. 8, 2015

(87) PCT Pub. No.: WO2014/167489
PCT Pub. Date: Oct. 16, 2014

(65) Prior Publication Data

US 2016/0068338 A1 Mar. 10, 2016

(30) Foreign Application Priority Data

Apr. 9, 2013 (BE) ..... 01300255

(51) Int. Cl.
*B65D 21/02* (2006.01)
*B65D 90/00* (2006.01)
*B66C 1/66* (2006.01)

(52) U.S. Cl.
CPC ..... *B65D 90/0006* (2013.01); *B65D 90/0026* (2013.01); *B66C 1/663* (2013.01)

(58) Field of Classification Search
CPC ..... B65D 90/0006; B65D 90/0026; B65D 88/022; B65D 88/121; B65D 21/00;
(Continued)

(56) References Cited

U.S. PATENT DOCUMENTS 4,212,251 A * 7/1980 DiMartino ..... B65D 90/0013 220/1.5
2004/0124647 A1 7/2004 Hase et al.

FOREIGN PATENT DOCUMENTS

DE 10104067 8/2002
GB 1417816 12/1975
(Continued)

OTHER PUBLICATIONS

International Search Report for PCT/IB2014/060517, Completed by the European Patent Office on Sep. 2, 2014, 7 Pages.
(Continued)

*Primary Examiner* — Fenn C Mathew
*Assistant Examiner* — Elizabeth J Volz
(74) *Attorney, Agent, or Firm* — Brooks Kushman P.C.

(57) ABSTRACT

A corner piece for forming a corner of a container, with a hold which can be grabbed by external gripping device, stacking elements in the shape of a solid protrusion and coupling elements which can be activated and deactivated and which includes a movable coupling element which can be moved between an activated position and a deactivated position, as well as an activator mechanism for activating and deactivating the coupling elements, which activator mechanism can be coupled to external driving elements.

18 Claims, 7 Drawing Sheets

(58) Field of Classification Search
CPC ..... B65D 21/0209; B66C 1/663; Y10T 24/28; Y10T 24/45225; Y10T 24/45969
USPC ..... 220/1.5, 640, 324, 23.6, 23.83; 206/503, 206/509, 512; 294/193; 410/69, 78; 24/287
See application file for complete search history.

(56) References Cited

FOREIGN PATENT DOCUMENTS

| | | |
|---|---|---|
| GB | 2134080 | 8/1984 |
| WO | 0236908 | 5/2002 |
| WO | 2011119109 | 9/2011 |

OTHER PUBLICATIONS

Search Report and Written Opinion for Belgium Application No. BE 201300255, Completed by the European Patent Office on Jan. 8, 2014, All together 8 Pages.

* cited by examiner

CORNER PIECE FOR FORMING A CORNER OF A CONTAINER, CONTAINER PROVIDED WITH SUCH CORNER PIECE, AND GRIPPER ARM AND GRIPPER WHICH CAN COOPERATE WITH SUCH CORNER PIECES

CROSS-REFERENCE TO RELATED APPLICATION

This application is the U.S. national phase of PCT Application No. PCT/IB2014/060517 filed on Apr. 8, 2014, which claims priority to BE Patent Application No. BE201300255 filed on Apr. 9, 2013, the disclosures of which are incorporated in their entirety by reference herein.

The present invention concerns an improved corner piece for forming a corner of a container.

The intention hereby is that such an improved corner piece is worked into or forms part of a chassis or supporting frame of a container, which, in particular, is a freight container intended for the transport of freight.

The present invention in particular concerns such an improved corner piece which is intended for handling containers and/or for stacking and/or securing containers on top of one another, on a quay, on the deck of a ship or another means of transport, such as a truck or a train or the like.

A freight container, often also referred to as shipping container or, in short, container, is a standardized beam-shaped box for the transportation of goods.

By using standard dimensions, the container can be transported by road, water and rail without the goods themselves having to be loaded or unloaded.

The most commonly used containers, such as the so-called ISO containers, are built around a chassis or supporting frame which is substantially made up of twelve supporting beams.

As is known, the twelve supporting beams of such a chassis of a freight container are mutually connected near their far ends by means of corner pieces, such that the whole forms a beam- or box-shaped volume.

Four bottom beams as well as four roof beams are hereby each mutually connected by means of such corner pieces in the shape of a rectangle so as to form a bottom framework and a roof framework respectively.

The roof framework and the bottom framework are further connected to the aforesaid corner pieces by means of four upright supporting beams or corner columns, referred to as "corner posts" in jargon.

If the container is intended for the transport of piece goods, the chassis will be usually closed on all sides by means of wall portions, whereby one of the crosscut ends of the beam-shaped container is provided with closable doors which allow access to the inner space.

The structural strength of such a container is mainly provided by the chassis. The roof wall and the side walls are typically made of profiled steel plates, while the bottom wall is usually made of wood with a water-resistant bottom.

There are also containers that are intended for the transport of liquefied gases rather than for piece goods, such as for example the so-called intermodal cryogenic ISO containers.

They consist of a comparable framework whereby in the inner space thereof is provided a tank for storing the liquefied gases.

The present invention also concerns improved corner pieces which are intended for all sorts of containers, regardless of their design which is tailored to the type of freight for which they are intended.

In general, containers must undergo diverse manipulations.

Thus, containers must be often moved or lifted, for example as of a means of transport such as a truck, a train or ship to a quay, and vice versa, or between several means of transport.

Several containers are hereby often stacked on top of one another and the containers are secured, for example to the means of transport, a quay or the like, or they are coupled to each other, or a combination of the above-mentioned actions.

In the known freight containers that are currently an international standard in use, what are called the ISO containers, the eight corner points of the chassis are provided with what are called "corner castings" or ISO-standardised corner pieces.

The ISO-standardised corner pieces are situated at a precise distance from each other and perform several critical functions.

A container should and may only rely on its four ISO-standardised corner pieces.

The ISO-standardised corner pieces usually carry at least 8.5 tons each.

Such known ISO-standardised corner pieces consist mainly of a hollow box made of steel, substantially cube-shaped or beam-shaped, of which three sides, when fitted, are essentially invisible due to their connection to the corner posts on which they are provided on the one hand, and to the two leaning supporting beams of either a roof framework or a bottom framework on the other hand.

The three visible sides are provided with a substantially oval opening that opens into an inner hollow space in the corner piece and that can thus serve as a receptor for a gripping means, stacking means or locking means provided with a protrusion which can be inserted in the opening.

These ISO-standardised corner pieces make it possible for the ISO containers that are equipped with the latter to easily undergo the above-mentioned various manipulations.

One of the major advantages of the use of the ISO-standardised corner pieces consists in that they can cooperate with numerous gripping means, stacking means, locking means and coupling means.

The ISO-standardised corner pieces allow for example to pick up ISO containers with what are called "spreaders" or grippers, which are usually provided on quay cranes and what are called "straddle carriers" in jargon.

To that end, such grippers for ISO containers are provided with four gripper arms which conform to or may be conformed to the four corners of the roof framework of a freight container, which gripper arms are each provided with typical gripping means, called "twist locks" in jargon.

Such gripping means or twist locks exist in various forms, but they have as a common feature that they are provided with a rotatable protrusion having an asymmetrically widened far end, the arrangement being such that the protrusion can be led in the oval opening, at least when the asymmetrically widened far end is positioned in a first orientation, while this asymmetrically widened far end, after having been rotated in the inner hollow space of the ISO-standardised corner piece, can only be removed from the oval opening under limited conditions.

In practice, such grippers of straddle carriers and quay cranes are provided with externally actuated gripping means or twist locks.

In order to stack ISO containers fitted with ISO-standardised corner pieces, use is made of stacking means in the shape of what are called "stacking cones", which consist of a plate element provided with a protrusion on either side fitting in an opening of an ISO-standardised corner piece and with which any mutual displacement of stacked containers resulting from horizontal forces can be prevented.

Placing these stacking means in the shape of "stacking cones" on the four corners between two containers to be stacked is usually done manually by a stevedore, as well as the removal of these "stacking cones", which is a time-consuming job and often also dangerous work.

The ISO-standardised corner pieces also make it possible for ISO containers fitted with them to be secured on a site by means of locking means, for example provided on the deck of a ship or on a truck, a wagon or another type of loading wagon.

Securing such an ISO container on a site or on a vehicle is done by means of locking means, which usually consist of twist locks, which are usually permanently installed on the site concerned or on the means of transport concerned, and which typically require the manual operation of a stevedore.

In particular when loading a vehicle, the time-consuming fixation of the locking means adversely effects the efficiency of the transport.

A container which has just been loaded on a truck, a wagon or another load wagon by a container crane must be fixed by means of the aforesaid locking means, and this operation keeps the loading place occupied in the meantime.

Another operation which is often required with containers consists of a combination of the preceding operations, i.e. stacking the containers whereby the containers are additionally mutually connected or, in other words, locked to each other, in order to prevent any shifting and/or tilting of the containers in relation to the deck or in relation to one another.

In the case of ISO containers fitted with ISO-standardised corner pieces, coupling means are used to that end having a guiding or a positioning function during the stacking, as well as a locking function for the coupling.

To that end as well, coupling means in the shape of intermediary twist-locks are usually provided, fitted with two far ends, whereby each of these far ends can be locked to a single container or a few containers.

Unlike the stacking means in the shape of "stacking cones", the coupling means in the shape of intermediary "twist locks" cannot only resist horizontal forces, but also separation forces which occur in case of any imminent tilting of containers.

A known disadvantage of the use of such known coupling means or intermediary twist-locks for coupling containers is that their locking also requires a manual action.

However, not all such intermediary twist-locks require an equal number of manual operations.

The fully manual double twist-locks obviously require most manual operations, whereby when coupling two containers, said intermediary twist-locks must be manually locked on both containers.

Nowadays, however, semi-automatically locking intermediary twist-locks are most often used, which are to be manually positioned at the bottom of a first container, but when this container is placed on a second container, the locking is accomplished automatically.

However, when lifting the aforesaid first container from the second container again, the semi-automatically locking twist locks must be manually released again first, which is a very time-consuming task, especially with high-stacked containers.

Indeed, in the case of high-stacked containers, a stevedore must unlock the semi-automatic twist locks with long rods, or the stevedore must be brought in the vicinity of the intermediary twist-lock to unlock them before the container can be unloaded.

Containers can also be mutually connected by means of full-automatically locking intermediary twist-locks, which solves the latter problem, so that the last placed container can be lifted from a previously provided container without any direct manual intervention of a stevedore.

Disconnecting containers which are coupled by means of such full-automatically lockable, intermediary twist-locks is done in particular by means of a combined lifting and turning motion or a so-called "twist motion" of the container, equipped with the "spreader".

Removing these full-automatically lockable, double twist-locks from the bottom of a lifted container still requires a manual operation, however.

Further, the full-automatically lockable, intermediary twist-locks must be correctly placed on the container according to a specific pattern in order to make the aforesaid "twist motion" for detaching the container actually work.

In order to couple containers, the full-automatically lockable, intermediary twist-locks are provided with a protrusion on one far end with a laterally extending bulge, which hereafter will be called a nose, whereby one must make sure, when providing these intermediary twist-locks, that the noses point in a first direction on a first end face and that the noses on the opposite end face point in the opposite direction.

Mistakes made while placing these full-automatically lockable, intermediary twist-locks can result in a huge loss of time and thus economic damage.

From what precedes it is clear that the ISO-standardised corner pieces have many advantages, but also quite a number of disadvantages.

First, it appears that in many cases, when manipulating containers provided with such ISO-standardised corner pieces, manual actions are required which are time-consuming and thus reduce the efficiency of the transport processes, while the manual operations may be often dangerous for the operators.

Another disadvantage of the known ISO-standardised corner pieces consists in that they do not offer a standardised solution to the different needs when manipulating a container, resulting in many diverse tools being required, in the shape of very diverse gripping means, stacking means, locking means and coupling means, as described above.

Also, the present invention aims to provide a solution to one or several of the aforesaid or possibly other disadvantages.

Another aim of the invention consists in developing a system which allows for little or no human errors, resulting in a safer system.

Yet another aim of the invention consists in ensuring a smooth transition to a new and more efficient system for handling and securing containers, whereby with the new system also the ISO-standardised containers provided with ISO-standardised corner pieces that are currently in use can still be used without any problems, in order to allow for a gradual replacement.

To this end, the invention in the first place concerns an improved corner piece for forming a corner of a container, which corner piece comprises a body designed to be provided between ribs of the container, whereby the corner piece additionally contains the following elements:

- a hold having a shape which can be grabbed by external gripping means;

stacking means containing a fixed part protruding from the body so as to form a static protrusion; and, coupling means which can be activated and deactivated and which contain a movable coupling element which can be moved between an activated position and a deactivated position, as well as an activator mechanism for activating and deactivating the coupling means, which activator mechanism can be coupled to external driving means.

Further, the invention also concerns a gripper arm which can cooperate with an improved corner piece according to the invention, as defined above in the most general terms, whereby the gripper arm forms a supplemental part of the invention in that only with a gripper arm according to the invention the true usefulness and practical use of an improved corner piece according to the invention can manifest itself in the most elementary form.

In particular, such a gripper arm according to the invention comprises at least:

gripping means which can grip the hold of the improved corner piece; and, driving means which can be coupled to the activator mechanism of such an improved corner piece and with which said activator mechanism can be driven.

In a less elementary form, the invention also concerns a container comprising at least one bottom framework, one roof framework and at least four corner posts, which corner posts reach from the roof framework to the bottom framework, and whereby every corner post is provided with a roof corner piece on one of its far ends which is part of the roof framework, and on the other end with a bottom corner piece which is part of the bottom framework and whereby the four roof corner pieces which are part of the roof framework are improved corner pieces according to the invention of a type as described above.

Further, another less elementary aspect of the invention also concerns a gripper for manipulating a container according to the invention, whereby such a gripper is provided with four gripper arms which can each cooperate with a corresponding improved roof corner piece of the container.

A first very important advantage of an improved corner piece according to the invention consists in that the improved corner pieces make it possible to manufacture containers which can be stacked onto one another, can be lifted from one another, can be coupled to one another and can be detached from one another without any additional separate tools such as "stacker cones" or "twist locks" or the like being required, and without any manual actions being necessary.

First of all, this implies that a lot of manual labour can be saved and much time can be gained, making the transport processes more efficient and resulting in reduced transport costs.

Moreover, such corner pieces according to the invention contribute greatly to the safety of the work force having to manipulate containers which are fitted with such corner pieces.

Further, the improved corner pieces according to the invention allow for a very thorough standardisation of the transport processes with containers, whereby the coupling means or stacking means are integrated in the containers themselves and are controllable via a remote, non-manual actuator.

In order to better explain the characteristics of the invention, the following preferred embodiments of a corner piece, a container, a gripper arm and gripper according to the invention are described by way of example only, without being limitative in any way, with reference to the accompanying drawings, in which:

FIG. 1 shows a first embodiment of a corner piece according to the invention, seen in perspective, whereby the coupling means are activated;

FIG. 2, analogous to FIG. 1, shows the same corner piece in perspective, whereby the coupling means are deactivated;

Figure 5:
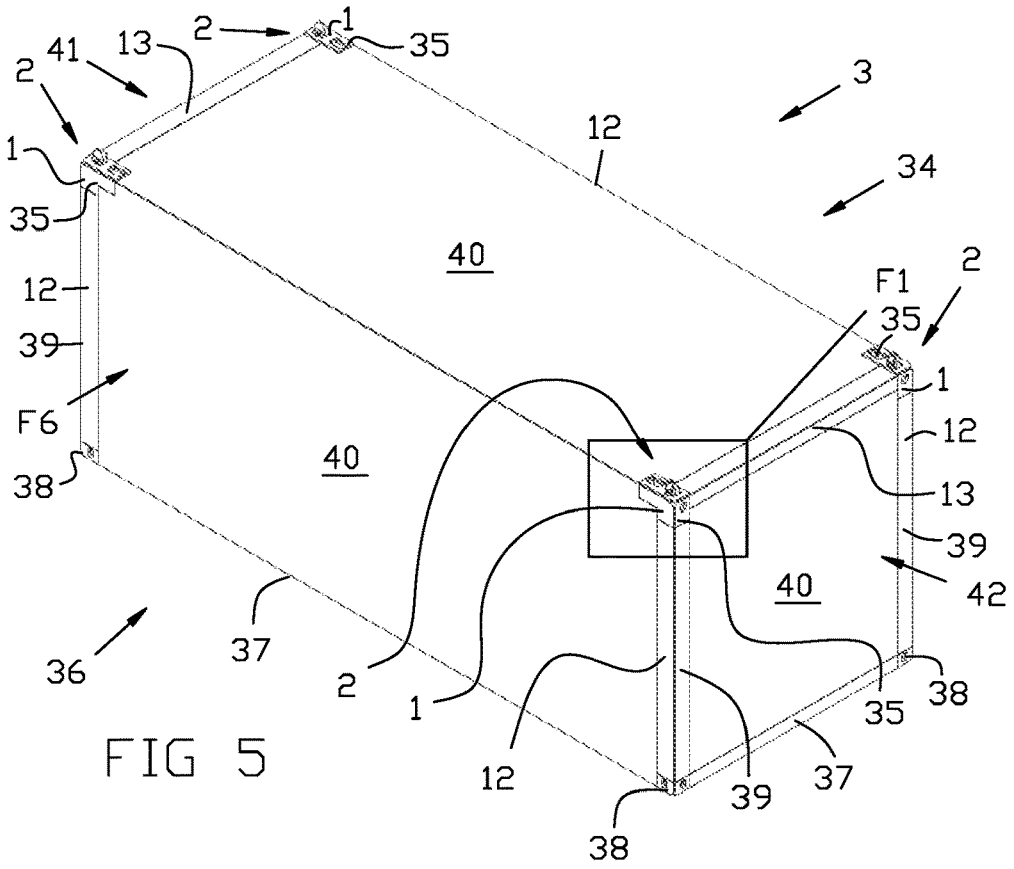
FIG. 5 shows a possible embodiment of a container according to the invention seen in perspective.
Figure 6:
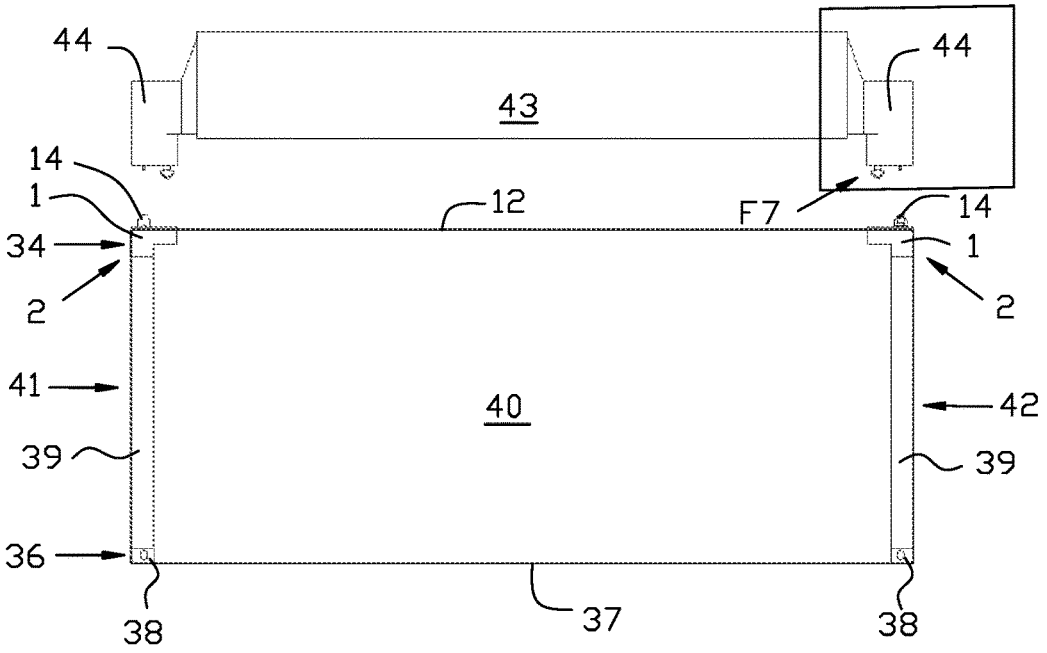
FIG. 6 shows a side elevation of the container according to arrow F6 indicated in FIG. 5, whereby a gripper according to the invention is represented above the container.

The improved corner piece 1 according to the invention, represented in FIGS. 1 to 4, is intended for forming a corner 2 of a container 3, as is represented in FIGS. 5 and 6.

The improved corner piece 1 is mainly formed of a metal body 4 which in the given embodiment consists of a beam-shaped element 4 with two legs 5 and 6 standing at right angles in relation to one another so as to form a beam-shaped L-shape 4.

The L-shaped body 4 has two parallel L-shaped side surfaces 7 which are connected by means of two outer surfaces 8 and 9 forming the outer corner of the L-shaped body 4, as well as two inner surfaces 10 and 11 forming the inner corner of the L-shaped body 4.

The L-shaped body 4 is designed to be provided between ribs of the container 3, whereby two ribs 12 extend in the prolongation of the legs 5 and 6 and a third rib 13 is provided perpendicular to the other two ribs 12.

According to the invention it is not excluded, however, to carry out the body 4 of an improved corner piece 1 with a different shape, for example in the shape of a cube or beam.

An improved corner piece 1 according to the invention is further provided with a static protrusion 14 in the shape of a substantially pin-shaped protrusion 14 extending in the direction AA' in the prolongation of one of the legs 5 and 6 of the L-shaped body 4, more or less in the middle of the leg 5.

The protrusion 14 forms a standing part extending transversely to the outer surface 8 of the L-shaped body 4 standing transversely to the aforesaid leg 5.

Said protrusion 14 on the improved corner piece 1 is designed among others as a guide when stacking containers 3 which are provided with such improved corner pieces 1, such that the protrusion 14 can be regarded as a tool when stacking containers 3 or thus as a stacking means 14.

Note that, thanks to a protrusion 14, a mutual shifting of stacked containers as a result of horizontal forces can be prevented as well.

Another major characteristic of an improved corner piece 1 according to the invention is that the improved corner piece 1 is provided with coupling means 15 which can be activated and deactivated.

Figure 1:
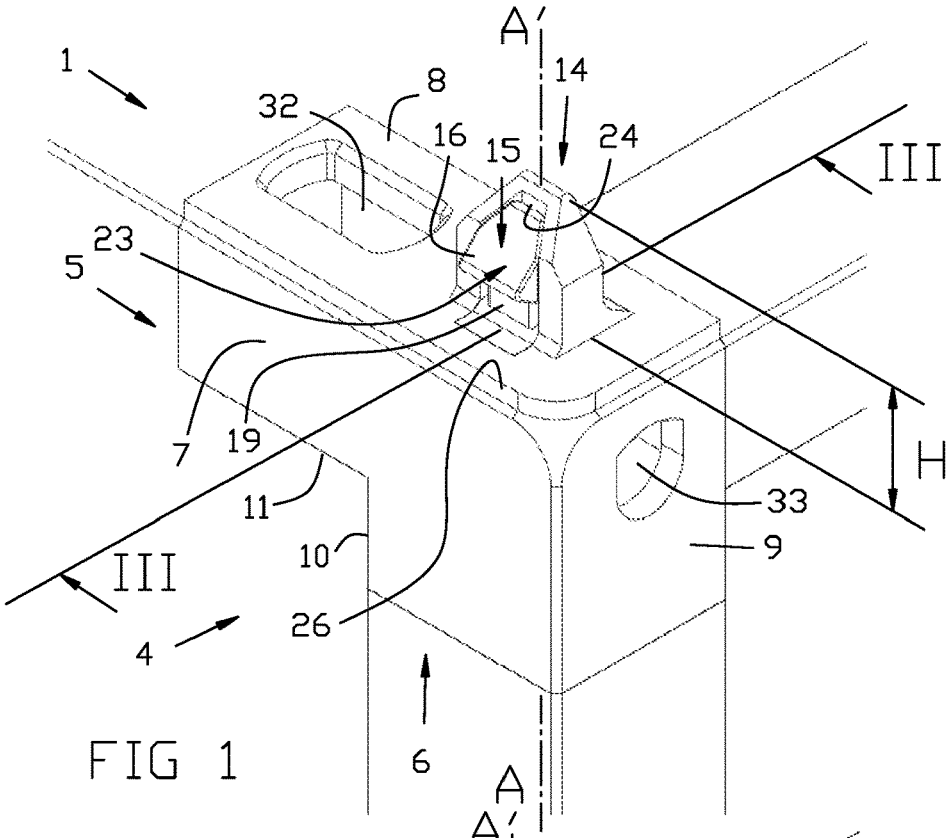
Figure 2:
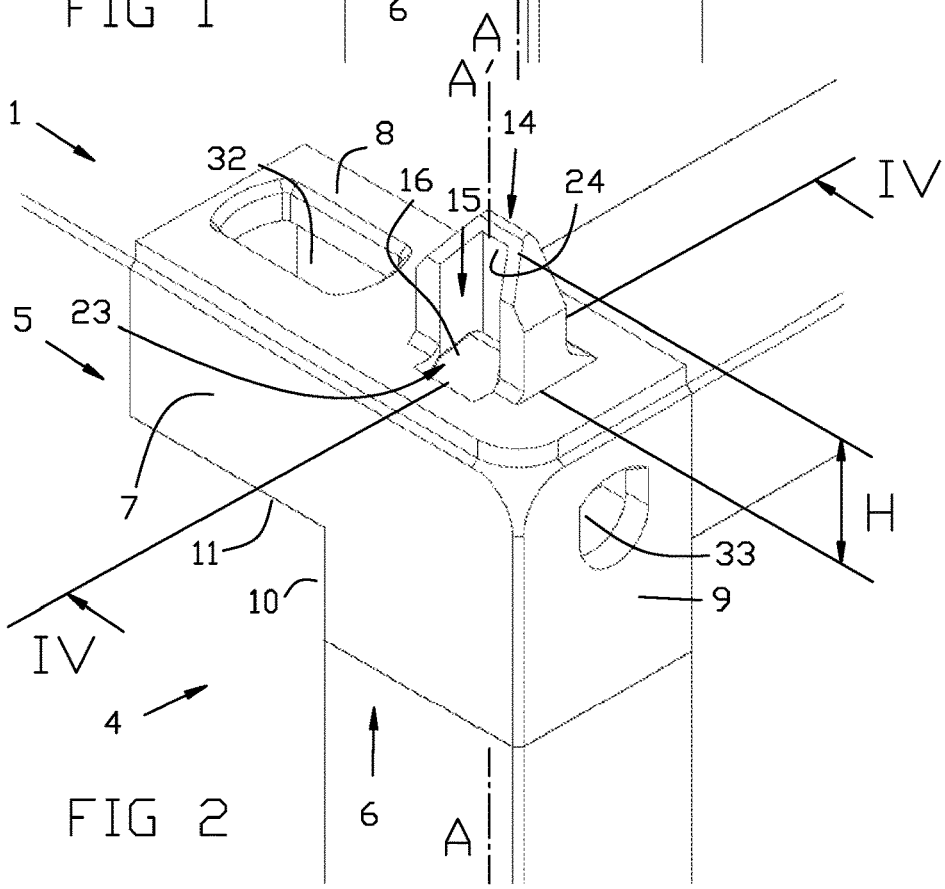
Figure 3:
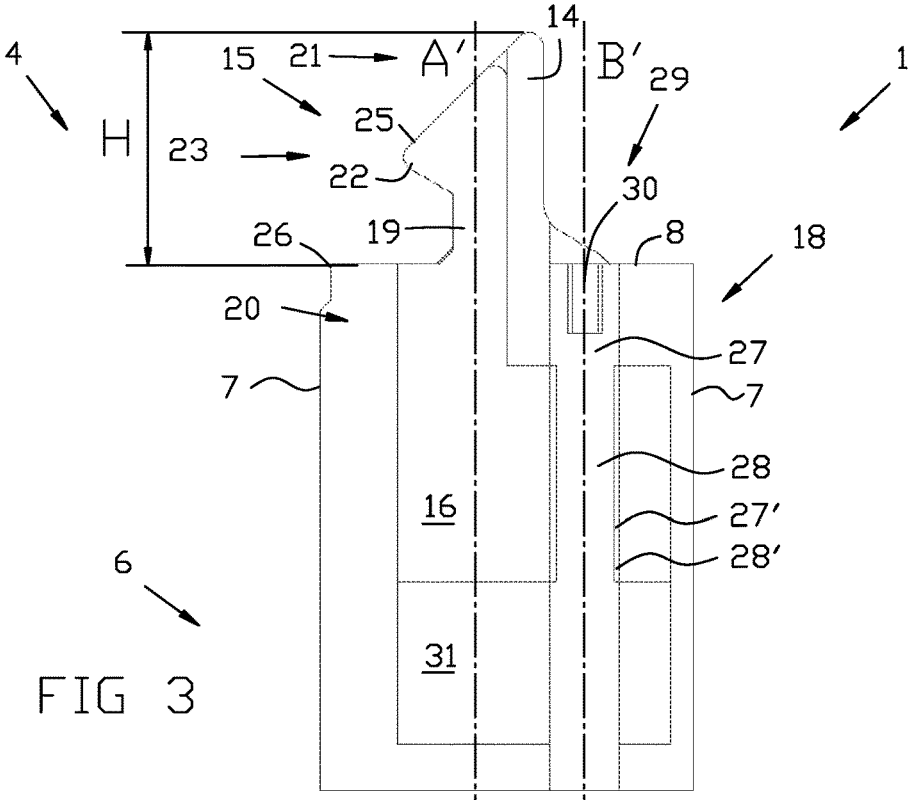
FIGS. 3 and 4 show sections through the corner piece, according to lines III-III and IV-IV respectively as indicated in FIGS. 1 and 2.
Figure 4:
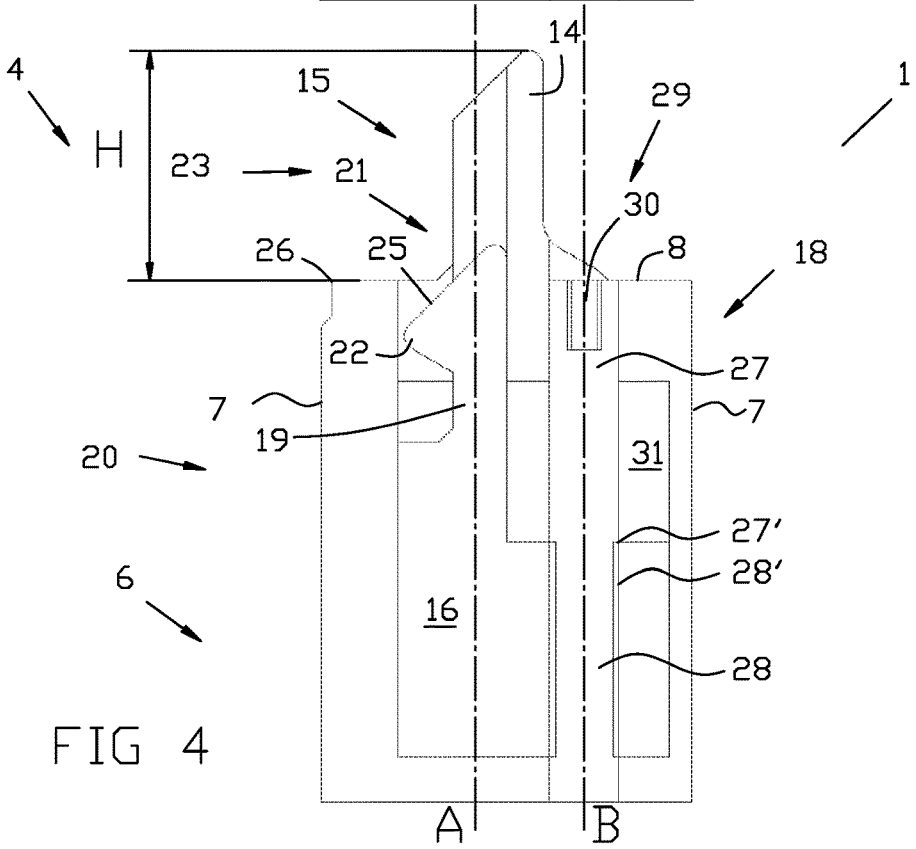

More specifically, the coupling means 15 comprise a movable coupling element 16 which can be moved between an activated, extended position, as is represented in FIG. 1, whereby the coupling element 16 protrudes at a certain height H from the body 4, and a deactivated, retracted position, as is represented in FIG. 2, whereby the coupling element 16 is situated within the contours of the body 4.

In the given example of FIGS. 1 to 4, the coupling element 16 of the coupling means 15 comprises a predominantly block-shaped housing 17 in which has been provided a part of an activator mechanism 18, as well as a longitudinal protrusion 19 which is fixed to one side 20 of said housing 17 and with which the actual coupling can be achieved.

This longitudinal protrusion 19 has a free far end 21 with a laterally protruding part 22 forming a nose 22 to that end.

The coupling element 16 can be moved up and down in the body 4 of the corner piece 1, whereby in the given embodiment, the longitudinal protrusion 19 of the coupling element 16 cooperates with the protrusion 14.

The static protrusion 14 is hereby provided on one side 23 with a slot 24 provided centrally in this side 23, whereby the coupling element 16, in particular the longitudinal protrusion 19 with its nose 22, can be moved up and down in said slot 24.

Moreover, the protrusion 14 and the nose 22 of the coupling element 16 are both bevelled on the side 23, such that in the activated position of the coupling element 16, the whole formed of the protrusion 14 and the longitudinal protrusion 19 forms a bevelled portion 25 extending in the direction of the lateral edge 26 of the corner piece 1.

Naturally, the orientation of the nose 22 in relation to the body 4 of the corner piece 1 may be different according to the invention, depending in what way one wishes to integrate the corner piece 1 in a container 3.

In the given embodiment of FIGS. 1 to 4, the activator mechanism 18 is formed of a worm 27 with an external screw thread 27' which is rotatably mounted in the body 4 and which is provided in an opening 28 in the coupling element 16.

The opening 28 is provided with a complementary internal screw thread 28' which can cooperate with the external screw thread 27' of the worm 27.

The worm 27 extends in the direction BB' parallel to the direction AA' in which the static protrusion 14 extends.

Depending on the direction of rotation according to which the worm 27 is rotated, the coupling element 16 is thus moved up or down.

The worm 27 extends with one far end 29 up to the outer surface 8 of the corner piece 1.

This far end 29 is provided with a recess 30, for example a hexagonal or square recess 30 making it possible to couple the activator mechanism 18 to external driving means, which will be discussed further on.

Further, the corner piece 1 is largely made hollow, whereby in this case openings are provided in the outer surfaces 8 and 9 on the hollow part 31, opening 32 and opening 33 respectively, which can serve as a hold with which external gripping means can grab the corner piece 1.

The opening 32 in the outer surface 8 is oval, fully in accordance with an oval opening as provided in a known ISO-standardised corner piece, such that the improved corner piece 1 can also be grabbed by a gripping means in the shape of a twist-lock as is customary with the existing containers.

In this embodiment of a corner piece 1 according to the invention, the protrusion 14 and the hold in the shape of an opening 32 are positioned next to one another, but this does not necessarily have to be the case according to the invention, as will be further demonstrated by means of another example.

FIG. 5 represents a container 3 according to the invention which is provided with improved corner pieces 1 according to the invention.

The container 3 hereby has a rectangular roof framework 34 formed of four ribs 12 of 13 which are connected by means of roof corner pieces 35, which roof corner pieces 35 are improved corner pieces 1 according to the invention.

The corner pieces 1 according to the invention, which are used as roof corner pieces 35, differ somewhat from the corner pieces 1 represented in the preceding FIGS. 1 to 4, whereby the protrusion 14 and the coupling means 15 are rotated a quarter turn in relation to the body 4 of the corner piece 1, but this does not change anything essential, as will become clear from the figures.

The container 3 also includes a rectangular bottom framework 36, also formed of four ribs 37 which are connected via corner pieces 38, which corner pieces 38 are of the ISO-standardised type however, as known according to the present state of the art.

The roof framework 34 and the bottom framework 36 are connected by means of four corner posts 39, and the container 3 is further sealed on all sides by means of panels 40 provided between the ribs 12, 13 or 36 concerned and the corner posts 39.

Another major characteristic of a container 3 according to the invention is that the four bottom corner pieces 38 are each provided with an opening so as to form a bottom framework 36 of the container 3 which, at the location of the four bottom corner pieces 38, is complementary to the four protrusions 14 provided on the four roof corner pieces 35 of the container 3, and in such a manner that several such containers 3 of the same type can be stacked in a fitting manner by making the protrusions 14 of a roof framework 34 of a bottom container 3 fit in the openings of the bottom corner pieces 38 of a top container 3.

In the given example of FIG. 5, this is effected by means of four bottom corner pieces 38 which are ISO-standardised corner pieces.

In order to be able to couple several containers 3 of the same type according to the invention during the stacking and to also detach them again without any manual intervention, it is further made sure that the coupling elements 16 of the roof corner pieces 35 in the activated position and the openings in the ISO-standardised bottom pieces 38 are also aligned in a certain way.

To this end, the roof corner pieces 35 of the roof framework 34 are not placed randomly oriented between the ribs of the container.

On the contrary, it is made sure that the two laterally protruding noses 22 on the coupling elements 16 of the roof corner pieces 35 at a first end face 41 of the container 3 are both oriented in a first given direction and the two laterally protruding noses 22 on the coupling elements 22 of the roof corner pieces 35 at the opposite end face 42 of the container 3 are both oriented in an opposite direction.

The aim here is that a similar arrangement is obtained as that which is applied when coupling means in the shape of the known fully automatic, self-latching, intermediary twist-locks are used for coupling containers, which is often the case now, as was explained in the introduction to the description of the state of the art.

In this way, a bottom container 3 according to the invention whose coupling means 15 have been put in the activated position can be coupled to an identical container 3 placed on top of it, by carrying out a combined movement with the top container 3 consisting of a downward movement and a rotational movement and without any manual intervention, entirely in accordance with a movement used with the known containers which are coupled with the fully automatic, self-latching, intermediary twist-locks.

Vice versa, the same is true when disconnecting the containers 3.

A major difference, however, is that with a container 3 according to the invention, the coupling means 15 themselves no longer require any manual operation, since they can be activated or deactivated entirely automatically and, as a result, no longer need to be installed or removed manually depending on whether the containers should be either or not coupled.

Figure 7:
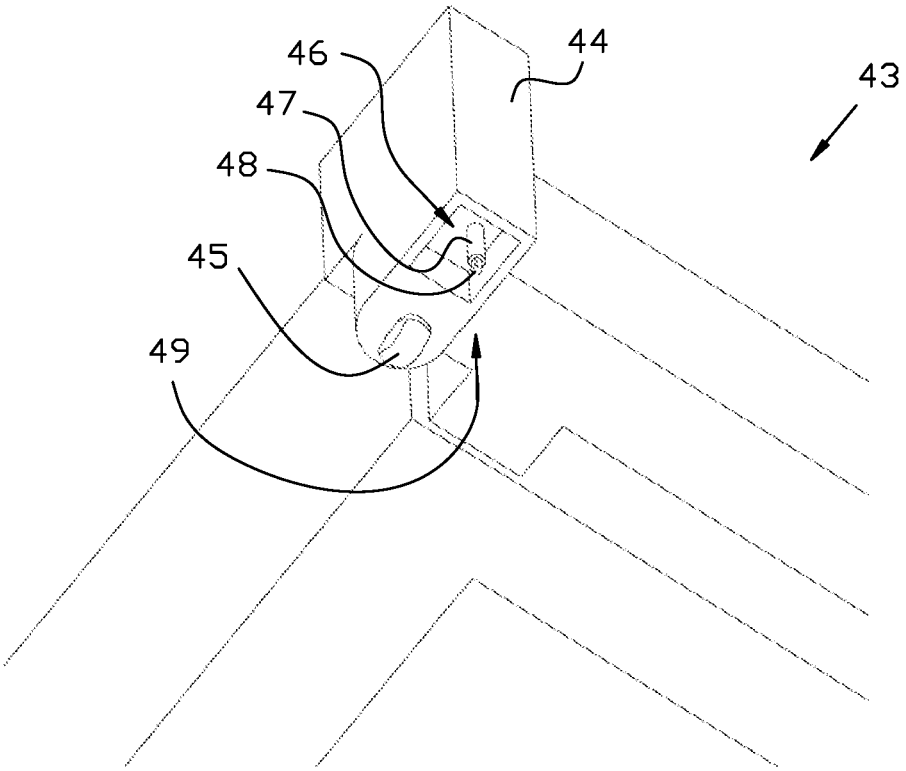
FIG. 7 shows a bottom view according to arrow F7 in FIG. 6 on a gripper arm according to the invention which is part of the gripper, in perspective and to a larger scale.
Figure 8:
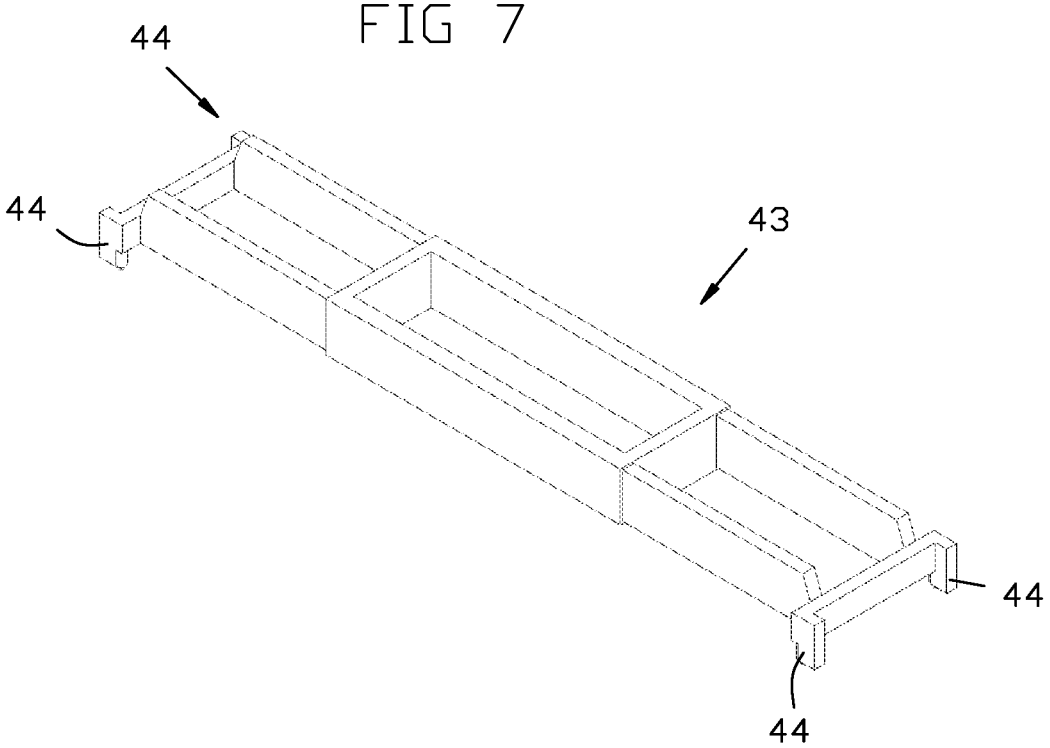
FIG. 8 shows the gripper from FIG. 6 in a more unfolded state.

In order to manipulate a container 3 according to the invention, use can be made of a gripper 43, an example of which is schematically represented in FIGS. 6 to 8.

The gripper 43 as shown is provided with four gripper arms 44 according to the invention, whereby every gripper arm 44 can cooperate with a corresponding roof corner piece 35 of a container 3 according to the invention.

To this end, such a gripper arm 44 first of all has gripping means 45 which can grab the hold 32 of such a roof corner piece 35 or improved corner piece 1 according to the invention.

In the given embodiment, this is effected by a hold 32 in the shape of an oval opening 32 in conformity with the openings in an ISO-standardised corner piece and by a twist-lock 45 which can be controlled by the gripper 43 and which can cooperate with the opening 32 and the cavity 31 in the roof corner pieces 35.

It is understood that in this embodiment, the grabbing of a container 3 according to the invention is entirely analogous to what is known from the ISO-standardised containers, so that in this case, the gripper 43 according to the invention or its gripper arms 44 can smoothly move existing ISO-standardised containers.

However, a gripper arm 43 according to the invention also has driving means 46 which can be coupled to the activator mechanism 18 of the coupling means 15 of an improved corner piece 1 according to the invention, with which this activator mechanism 18 can be driven so as to activate or deactivate the coupling means 15 of the corner piece 1 concerned.

In particular, the driving means 46 can rotatingly drive a shaft 47 so as to make this shaft 47 rotate around its centre in both directions of rotation, as well as to make this shaft 47 carry out a translational movement to and fro in relation to the gripper arm 44 according to the direction of the shaft 47.

Said shaft 47 can be coupled to the activator mechanism 18 of a corner piece 1 according to the invention, which in this case is effected by means of a square head 48 provided at the free far end 49 of the shaft 47, which head 48 can be provided in a fitting manner in the recess 30 at the far end 29 of the worm 27 of the activator mechanism 18 of the corner piece 1.

By coupling the shaft 47 to the worm 27 via a translational movement performed with the driving means 46 and by rotating the coupled shaft 47 with the driving means 46, the part 19 with the nose 22 can be moved up or down in relation to the body 4 of the corner piece 1, depending on the rotational direction of the shaft 47, in other words the coupling means 15 can thus be activated or deactivated.

It is clear that the transport system which is suggested according to the invention is very easy to use.

For example, when containers 3 according to the invention should be stacked without any mutual coupling, which is often the case, for example with containers 3 which are stacked in the hold of a ship as they are secured between guide rails, one only has to deactivate the coupling means 15 of each of the roof corner pieces 35 of the container 3 via the driving means 46 on the gripper arms 44 of the gripper 43, which can be simply done as of the cab of the crane operator.

The same applies when placing containers on the quay or on a transport vehicle such as a truck or the like, whereby the conventional solid twist-locks can still be used by anchoring them in the oval openings 32.

On the other hand, when during the stacking of containers 3, the containers 3 must be coupled, this can be done by activating the coupling means 15 of every roof corner piece 35 of a container via the driving means 46 on the gripper arms 44 of the gripper 3 before placing another container 3 on the aforesaid container 3 by means of a combined descending motion and rotational motion of the top container 3.

Disconnecting them is simply done in an analogous manner.

According to a preferred embodiment of a gripper 43 according to the invention, the gripper arms 44 are slidably mounted in the gripper 43 so as to be able to adjust the distance between the gripper arms 44 as a function of the dimensions of the roof framework 34 of the container 3, which is illustrated in FIG. 8.

Thus, containers 3 with very different dimensions can be easily manipulated.

Figure 9:
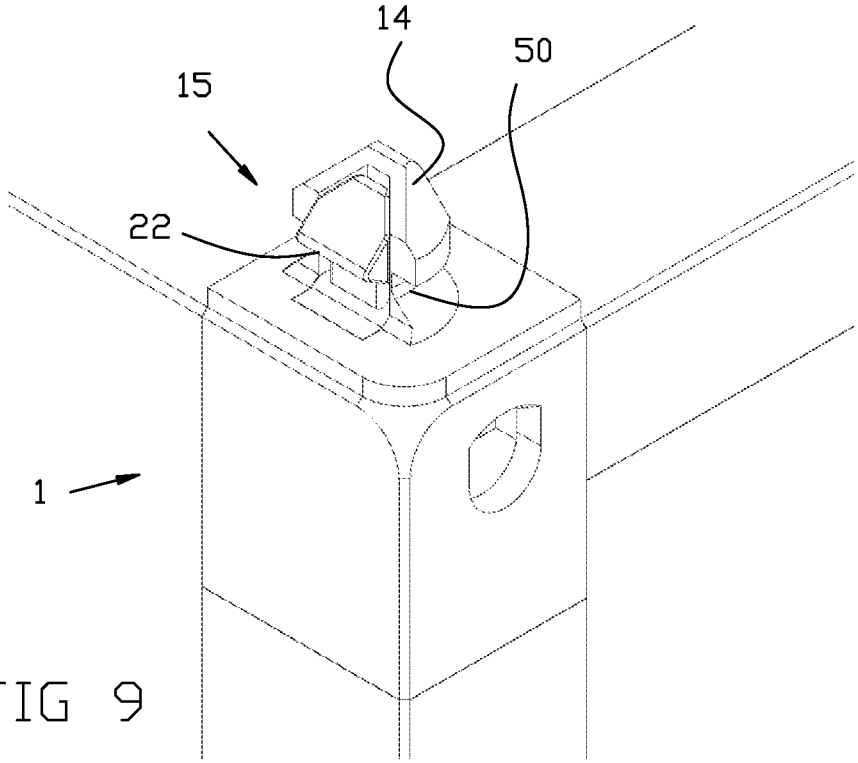
FIGS. 9 and 10 show another embodiment of a corner piece according to the invention seen in perspective, with the coupling means in the activated and in the deactivated position respectively.
Figure 10:
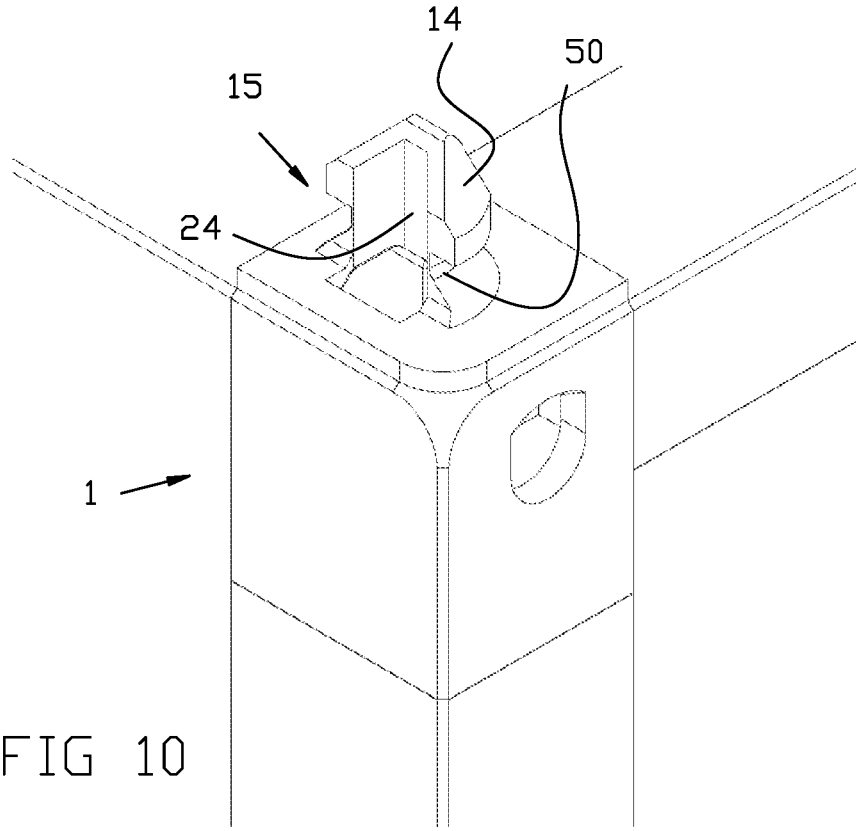

FIGS. 9 and 10 show yet another possible embodiment of a corner piece 1 according to the invention, in which the various functional components are somewhat more integrated.

More specifically, the protrusion 14 on the corner piece 1 in this case not only serves to simplify the stacking, but it also serves as a hold for a gripping means of an external gripper 43.

The hold on the corner piece 1 is now formed of an undercut 50 on the solid protrusion 14 on the body 4 of the corner piece 1.

The gripper arms 44 of a gripper 43 which can cooperate with such corner pieces 1 are preferably provided with gripping means to this end having a shape which is substantially complementary to the undercut 50 on the solid protrusion 14 on the body 4 of the corner piece 1 so as to be able to optimally grab the protrusion 14.

FIGS. 11 to 16 show some more possibilities of grippers 43 which could cooperate with a corner piece according to FIGS. 9 and 10.

Figure 12:
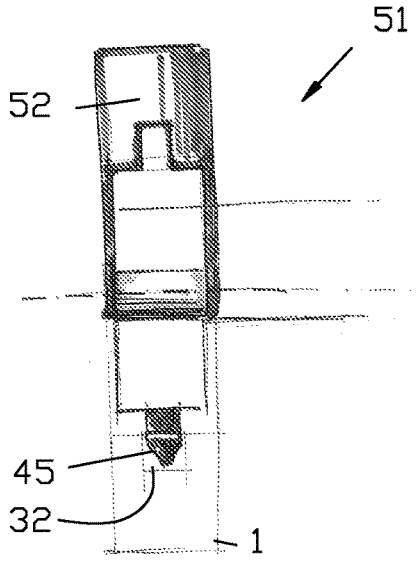
FIGS. 12 and 13 shows a side elevation of a gripper arm of the gripper from FIG. 11 in different positions, when gripping an ISO-standardised corner piece and a corner piece according to the invention respectively; and, FIGS. 14 to 16, in a manner analogous to that in FIGS. 11 to 13, show yet another embodiment of a gripper according to the invention.
Figure 15:
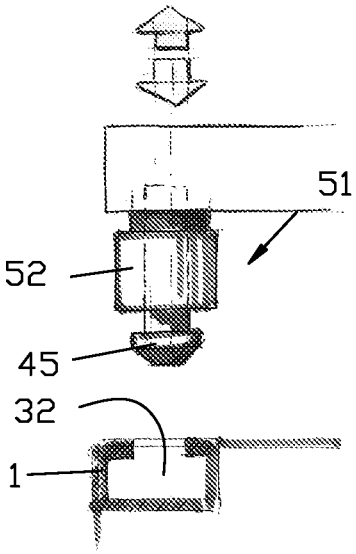

The gripper arms 43 are hereby provided with multiple gripping means 51 with which different types of holds provided on corner pieces 1 can be grabbed, more specifically a twist-lock 45 for grabbing a hold in the shape of an oval opening 32 in conformity with the ISO-standardised corner pieces, as is the case for example in FIGS. 12 and 15, as well as a head 52 with a complementary shape for grabbing a protrusion 14 via an undercut 50.

Figure 11:
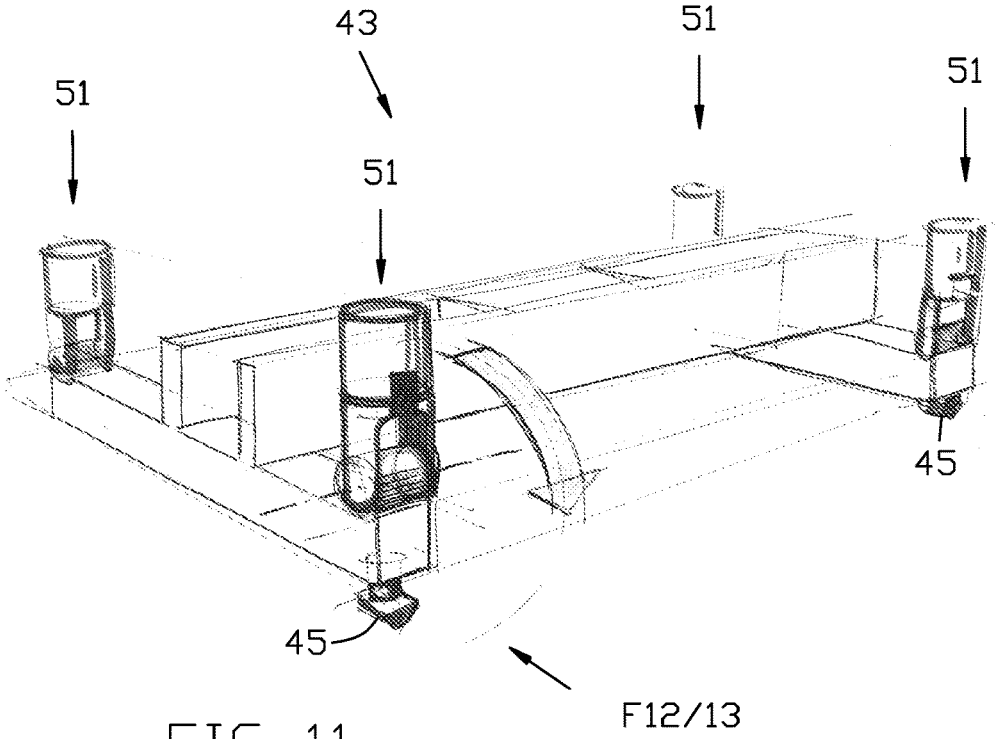
FIG. 11 shows an alternative embodiment of a gripper according to the invention seen in perspective, which gripper can cooperate with a corner piece according to FIGS. 9 and 10, as well as with an ISO-standardised corner piece.
Figure 13:
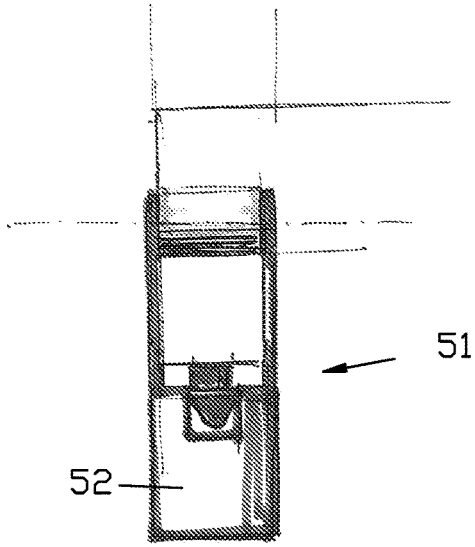
Figure 14:
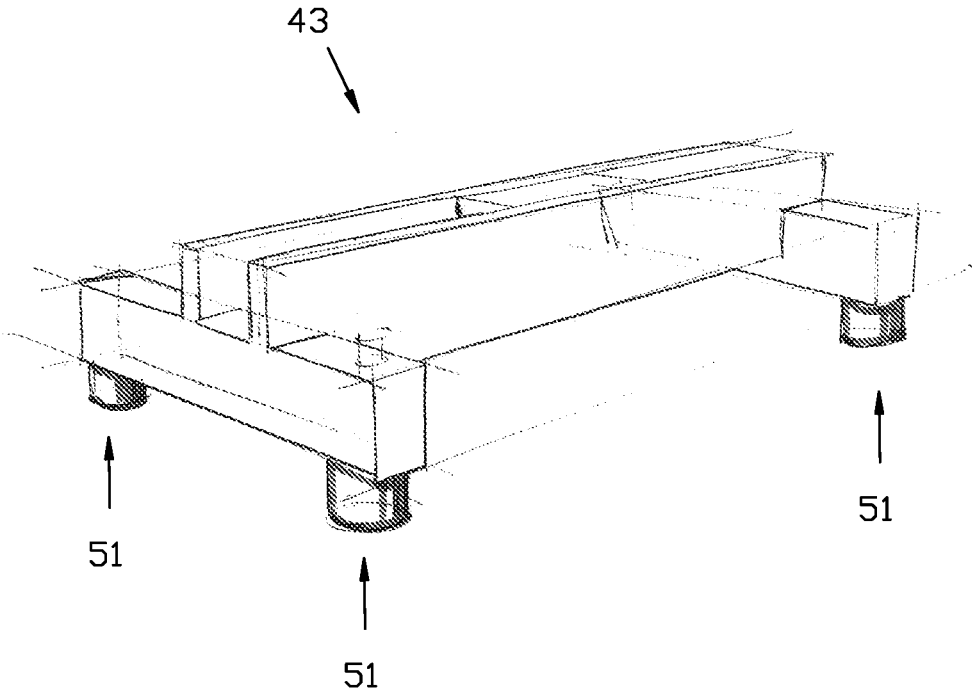
Figure 16:
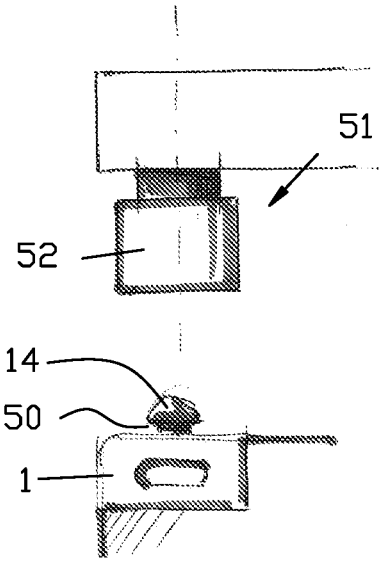

In the embodiment of FIGS. 11 to 13 one can switch between the two modes of operation by means of a rotation of the head 52 in relation to the twist-lock 45, whereas in the embodiment of FIGS. 14 to 16 one can switch by means of a relative translation between the head 52 and the twist-lock 45.

In this manner it can be ensured once more that the known ISO-standardised containers can be used without any problems, which is also an objective of the present invention.

Of course, many other embodiments according to the invention are not excluded.

The present invention is by no means restricted to the embodiments of an improved corner piece 1, a container 3, a gripper arm 44 and a gripper 43 according to the invention described by way of example; on the contrary, such improved corner pieces 1, containers 3, gripper arms 44 and grippers 43 can be made in all sorts of shapes and dimensions while still remaining within the scope of the invention.

The invention claimed is:

1. An improved corner piece for forming a corner of a container, which corner piece comprises:

a body to be provided between ribs of a container, having a corner piece comprising at least the following elements:

a hold opening formed in the body having a shape which can be grabbed by an external gripping means;

stacking means containing a fixed part protruding from the body along a vertical axis A' so as to form a static protrusion adjacent to and parallel the hold opening;

coupling means which can be activated and deactivated and which includes a movable coupling element which can be moved relative to the stacking means between an activated position and a deactivated position; and an activator mechanism for activating and deactivating the movable coupling element of the coupling means, which activator mechanism can be coupled to external driving means.

2. The improved corner piece according to claim 1, wherein the hold opening has the shape of an oval opening on a hollow part in the body of the corner piece according to an oval opening in an ISO-standardised corner piece, in which oval opening can mesh a gripping means in the shape of a twist lock.

3. The improved corner piece according to claim 1, wherein an aforesaid hold opening on the corner piece is formed of an undercut on the static protrusion on the body of the corner piece.

4. The improved corner piece according to claim 1, wherein the activator mechanism is formed of a worm and worm wheel, whereby the worm extends in a direction parallel to the direction in which the solid protrusion extends and whereby the worm wheel makes the coupling element move up or down depending on the sense of rotation according to which the worm is rotated.

5. The gripper arm which can cooperate with an improved corner piece according to claim 1, wherein the gripper arm at least comprises:

gripping means which can grab the hold opening of the improved corner piece; and, driving means which can be coupled to the activator mechanism of such an improved corner piece and with which such activator mechanism can be driven.

6. The gripper arm according to claim 5, wherein the driving means drive a shaft so as to make this shaft carry out a rotational movement in both its rotational directions on the one hand, and so as to make this shaft carry out a translational movement to and fro according to the direction of the shaft and whereby the shaft can be coupled to a worm of the drive mechanism of an aforesaid corner piece.

7. The gripper arm according to claim 5, wherein the gripping means comprise at least a twist-lock which can mesh in a hold opening formed of an oval opening on a hollow part in the body of an aforesaid corner piece.

8. The gripper arm according to claim 5, wherein the gripping means are provided with a shape which is complementary to an undercut on a solid protrusion on the body of the corner piece so as to be able to grab the protrusion.

9. The gripper arm according to claim 5, wherein the gripper arm is provided with multiple gripping means with which different hold openings on corner pieces can be grabbed.

10. An improved corner piece for forming a corner of a container, which corner piece comprises a body designed to be provided between ribs of the container, wherein the corner piece additionally contains at least the following elements:

a hold having a shape which can be grabbed by external gripping means;

stacking means containing a fixed part protruding from the body so as to form a static protrusion; and, coupling means which can be activated and deactivated and which contain a movable coupling element which can be moved between an activated position and a deactivated position, as well as an activator mechanism for activating and deactivating the coupling means, which activator mechanism can be coupled to external driving means;

wherein the coupling element can be moved between an activated, extended position, whereby the coupling element extends at least partly over a certain height from the body, and a deactivated, retracted position, whereby the coupling element is at least partly retracted within the contours of the body in relation to the activated position.

11. The improved corner piece according to claim 10, wherein the coupling element of the coupling means is provided with a longitudinal protrusion with which the actual coupling can be performed, having a free far end provided with a laterally protruding part forming a nose, whereby the coupling element can be moved up and down in the body of the corner piece between an activated, upright position, whereby the longitudinal protrusion forms an upright portion on the body of the corner piece, and a deactivated, retracted position, whereby the longitudinal protrusion is entirely retracted within the body of the corner piece.

12. The improved corner piece according to claim 10, wherein the static protrusion forms an upright portion on the body, which upright portion is provided on one side with a slot provided centrally in said side, in which the coupling element is provided such that it can be moved up and down.

13. The container comprising at least a bottom framework, a roof framework and at least four corner posts, which corner posts reach as of the roof framework to the bottom framework, and whereby every corner post is provided with a roof corner piece on one of its far ends which is part of the roof framework, and with a bottom corner piece on the other far end which is part of the bottom framework, wherein the four roof corner pieces comprises a body designed to be provided between ribs of the container, wherein the corner piece additionally contains at least the following elements:

a hold opening having a shape which can be grabbed by external gripping means;

stacking means containing a fixed part protruding from the body so as to form a static protrusion; and, coupling means which can be activated and deactivated and which contain a movable coupling element which can be moved between an activated position and a deactivated position, as well as an activator mechanism for activating and deactivating the coupling means, which activator mechanism can be coupled to external driving means;

wherein the coupling element of the coupling means is provided with a longitudinal protrusion with which the actual coupling can be performed, having a free far end provided with a laterally protruding part forming a nose, whereby the coupling element can be moved up and down in the body of the corner piece between an activated, upright position, whereby the longitudinal protrusion forms an upright portion on the body of the corner piece, and a deactivated, retracted position, whereby the longitudinal protrusion is entirely retracted within the body of the corner piece;

wherein the two laterally protruding noses on the coupling elements of the roof corner pieces on a first end face of the container are both directed in a first given direction and the two laterally protruding noses on the coupling elements of the roof corner pieces on the opposite end face of the container are both directed in an opposite direction.

14. The container according to claim 13, wherein the four bottom corner pieces are each provided with an opening so as to form a bottom framework of the container which, at the four bottom corner pieces, is complementary to the four protrusions provided on the four roof corner pieces of the container, in such a way that several such containers of the same type can be stacked in a fitting manner.

15. The container according to claim 14, wherein the four bottom corner pieces are ISO-standardised corner pieces.

16. The container according to claim 13, wherein the coupling elements of the roof corner pieces, in their activated position, and the openings in the ISO-standardised bottom pieces are aligned, such that these identical containers can be stacked and coupled to one another and detached again by performing a combined movement with one of the containers consisting of an upward or downward movement and a rotational movement, without any manual intervention.

17. The gripper for manipulating a container according to claim 13, wherein the gripper is provided with four gripper arms whereby every gripper arm can cooperate with a corresponding roof corner piece of the container.

18. The gripper according to claim 17, wherein the gripper arms are slidably mounted in the gripper so as to be able to adjust the distance between the gripper arms as a function of the dimensions of the roof framework of the container.

* * * * *